US006334787B1

(12) United States Patent
Chang

(10) Patent No.: US 6,334,787 B1
(45) Date of Patent: Jan. 1, 2002

(54) ELECTRIC CONNECTOR WITH A SPACE-SAVING LED LEAD-OUT WIRE AND CIRCUIT BOARD ARRANGEMENT

(75) Inventor: Chih-Kai Chang, Sanchung (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 09/842,852

(22) Filed: Apr. 27, 2001

(51) Int. Cl.[7] ..... H01R 3/00
(52) U.S. Cl. ..... 439/490; 439/620
(58) Field of Search ..... 439/76.1, 55, 490, 439/607, 620, 676

(56) References Cited

U.S. PATENT DOCUMENTS 6,224,417 B1 * 5/2001 Belopolsky et al. ..... 439/490
6,227,911 B1 * 5/2001 Boutros et al. ..... 439/620
6,257,906 B1 * 7/2001 Price et al. ..... 439/131

* cited by examiner

*Primary Examiner*—Khiem Nguyen
(74) *Attorney, Agent, or Firm*—Bacon & Thomas, PLLC

(57) ABSTRACT

An electric connector includes an electrically insulative housing covered with a metal shield, and an electric circuit assembly unit installed in the electrically insulative housing, the electric circuit assembly unit including a terminal holder holding a set of terminals and mounted in the electrically insulative housing, and a circuit board supported on the terminal holder, the terminal holder having a base, a front extension board and a rear extension board horizontally extended from the base in reversed directions, and an upright support at the rear extension board, the circuit board having two light emitting diodes controlled to emit light toward a front receiving side of the electrically insulative housing, the terminal holder having ten terminal slots vertically extended through the rear extension board and arranged in two rows, the circuit board having ten terminals arranged in two rows and respectively inserted through respective terminal slots of the terminal holder, the terminals of the circuit board including four terminals respectively connected to lead-out wires of the light emitting diodes and six signal receiving and transmitting terminals respectively connected to the terminals of the terminal holder.

6 Claims, 12 Drawing Sheets

ELECTRIC CONNECTOR WITH A SPACE-SAVING LED LEAD-OUT WIRE AND CIRCUIT BOARD ARRANGEMENT

BACKGROUND OF THE INVENTION

The present invention relates to electric connectors, and more specifically, to an electric connector with a space-saving LED lead-out wire and circuit board arrangement.

Following fast development of computer technology, advanced desktop and notebook computers have been continuously developed. In consequence, a variety of electric connectors have been disclosed for use with different computers and the telephone line for connection to the Internet to obtain data. Currently, RJ45 connectors are commonly used for enabling a computer to be connected to the Internet. A RJ45 connector may be provided with indicator LEDs (light emitting diodes) for signal transmission indication. However, the operation of LEDs in a RJ45 connector produces high-frequency electric waves that interfere with operation of nearby electric/electronic apparatus. Further, external noises may interfere with the transmission of signal in conventional RJ45 connectors. In order to protect against EMI (electromagnetic interference), a computer connector is generally covered with a metal shield and installed with a filter module. A capacitor may be provided in the filter module to protect against surge. An electric connector with EMI protective circuit means is expensive. Various electric connectors are known having light emitting means for operation indication. In one prior art arrangement as shown in FIGS. 7 and 8, light emitting diodes are mounted on the inside of the electric connector with the respective lead-wires respectively soldered to the circuit board at the bottom side inside the electric connector, and light guide strips are provided in the electric connector and adapted to guide the light of the light emitting diodes to the front side of the electric connector. In another prior art arrangement as shown in FIGS. 9 and 10, light emitting diodes are directly soldered to the circuit board at the bottom side inside the electric connector, and light guides are provided in the electric connector and adapted to guide the light of the light emitting diodes to the front side of the electric connector. In still another prior art arrangement as shown in FIGS. 11 and 12, light emitting diodes are directly mounted in the visible front side of the electric connector, and the lead-wires of the light emitting diodes are curved and inserted through a partition wall and then respectively soldered to the circuit board (not shown) at the bottom side inside the electric connector. In the aforesaid first prior art arrangement, the use of the light guide strips greatly increases the manufacturing cost of the electric connector. Because the light of the light emitting diodes is reflected to the front side of the electric connector by the light guide strips, the intensity of light is relatively weakened when reaching the front side of the electric connector. Further, because the lead-wires of the light emitting diodes are directly soldered to the circuit board, the circuit board does not have sufficient mounting space for the mounting of capacitor and filter module. In the aforesaid second prior art arrangement, because the light emitting diodes are directly soldered to the circuit board, the cost of the circuit board is relatively increased. Further, the use of the light guides also greatly increases the manufacturing cost of the electric connector, and the modification of the circuit layout of the circuit board is complicated when wishing to add filter circuit means to the circuit board. Further, in the aforesaid third prior art arrangement, the terminals extended from the circuit board through the terminal holder are of 6P8C design (6 in and 8 out), and the terminal slots on the terminal holder are arranged in two rows or three rows. Fitting a terminal holder having terminal slots arranged in two rows, the circuit board is vertically disposed at the rear side of the terminal holder, and a filter module and a capacitor are directly soldered to the circuit board. The terminal slots at the first row are adapted to receive 8 terminals for receiving and transmitting signal, and the terminal slots at the second row are adapted to receive the lead-wires of two light emitting diodes (see FIGS. 11 and 12). Fitting a terminal holder having terminal slots arranged in three rows, the circuit board is also disposed at the rear side of the terminal holder in vertical. The terminal slots at the first and second rows are adapted to receive the 6 terminals for receiving and transmitting signal, and the terminal slots at the third row are adapted to receive the lead-wires of two light emitting diodes (see FIGS. 13 and 14). Because the light emitting diodes are directly mounted in the electrically insulative housing, the lead-wires of the light emitting diodes are turned downwards through 90° and then inserted through the respective terminal slots on the terminal holder. In case the light emitting diodes are installed in the front side of the electric connector, the lead-wires of the light emitting diodes must have a certain length for connection to the circuit board. The arrangement of the light emitting diodes greatly complicates the fabrication of the electric connector and the installation of capacitor and filter module means.

SUMMARY OF THE INVENTION

The present invention has been accomplished to provide an electric connector, which eliminates the aforesaid drawbacks. It is the main object of the present invention to provide an electric connector, which requires less vertical installation space. It is another object of the present invention to provide an electric connector, which is easy to assemble/disassemble. According to one aspect of the present invention, the electric connector comprises an electrically insulative housing covered with a metal shield, and an electric circuit assembly unit installed in the electrically insulative housing, the electric circuit assembly unit including a terminal holder holding a set of terminals and mounted in the electrically insulative housing, and a circuit board supported on the terminal holder, the terminal holder having a base, a front extension board and a rear extension board horizontally extended from the base in reversed directions, and an upright support at the rear extension board, the circuit board having two light emitting diodes controlled to emit light toward a front receiving side of the electrically insulative housing, the terminal holder having ten terminal slots vertically extended through the rear extension board and arranged in two rows, the circuit board having ten terminals arranged in two rows and respectively inserted through respective terminal slots of the terminal holder, the terminals of the circuit board including four terminals respectively connected to lead-out wires of the light emitting diodes and six signal receiving and transmitting terminals respectively connected to the terminals of the terminal holder. According to another aspect of the present invention, the circuit board is horizontally supported on the base and upright support of the terminal holder to minimize the occupation of installation space of the electric connector. According to still another aspect of the present invention, the circuit board comprises capacitor and filter module means adapted to protect the internal circuit against external noises. According to the horizontal arrangement of the circuit board and the terminal holder, the horizontal length as well as the vertical height of the electric connector is minimized. Further, because the capacitor, the light emitting diodes and the filter module are respectively installed in the circuit board, the maintenance work of the electric connector is easy.

DETAILED DESCRIPTION OF THE PREFERRED EMBODIMENT

Figure 1:
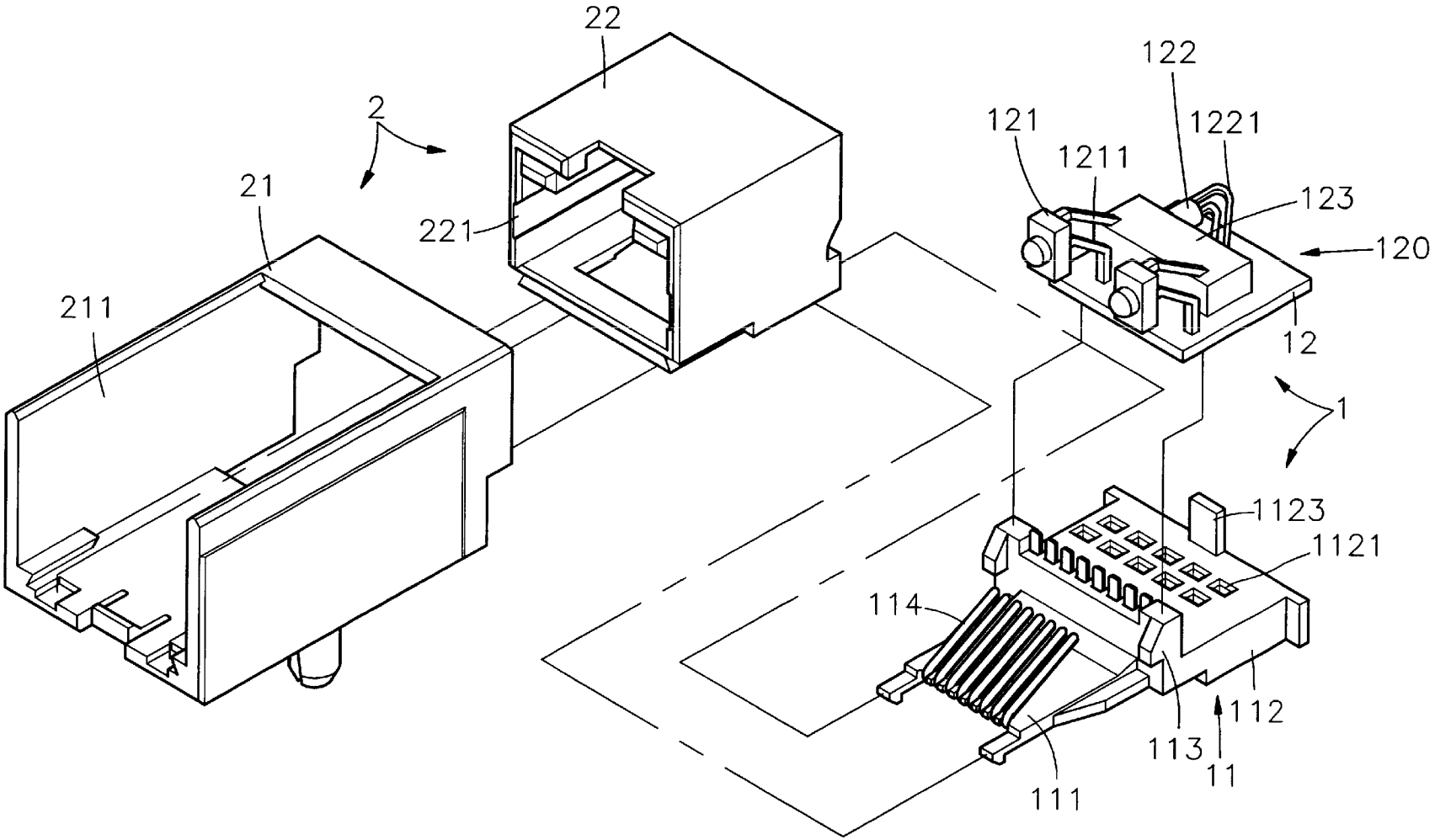
FIG. 1 is an exploded view of an electric connector constructed according to the present invention (the metal shield excluded).

Referring to FIGS. from 1 through 4, an electric connector is shown comprising an electric circuit assembly unit 1, an electrically insulative housing 2, and a metal shield 3.

The electric circuit assembly unit 1 is comprised of a terminal holder 11 and a circuit board 12. The terminal holder 11 is a flat rectangular member comprising a base 113, a front extension board 111 forwardly extended from the base 113, a rear extension board 112 backwardly extended from the base 113, and a plurality of terminals 114 mounted in the front extension board 111 and the base 113 and arranged in parallel. The rear extension board 112 has a plurality of terminal slots 1121. The terminals 114 each have a front end protruded from the front side of the front extension board 111 and turned backwardly upwards, and a rear end backwardly extended out of the base 113 and soldered to the circuit board 12. The circuit board 12 is horizontally supported on the base 113 of the terminal holder 11 and an upright support 1123 of the rear extension board 112, comprising an electronic component part unit 120 and a plurality of terminals 1122. The electronic component part unit 120 includes two light emitting diodes 121, a capacitor 122, and a filter module 123. The terminals 1122 each have one end respectively soldered to the circuit board 12 and an opposite end respectively inserted through the terminal slots 1121 of the rear extension board 112 of the terminal holder 11 for connection to a respective contact of an external circuit board (not shown). The electrically insulative housing 2 comprises an outer casing 21 and an inner casing 22. The outer casing 21 comprises a receiving chamber 211 adapted to receive the inner casing 22. The inner casing 22 fits into the outer casing 21, comprising a receiving chamber 221 adapted to receive a matching electric connector. After insertion of the inner casing 22 into the rear end of the outer casing 21, a gap is defined between the bottom sidewall of the outer casing 21 and the bottom sidewall of the inner casing 22 for receiving the front extension board 111 of the terminal holder 11 of the electric circuit assembly unit 1. The metal shield 3 is covered on the electrically insulative housing 2 for EMI (electromagnetic interference) protection.

Figure 5:
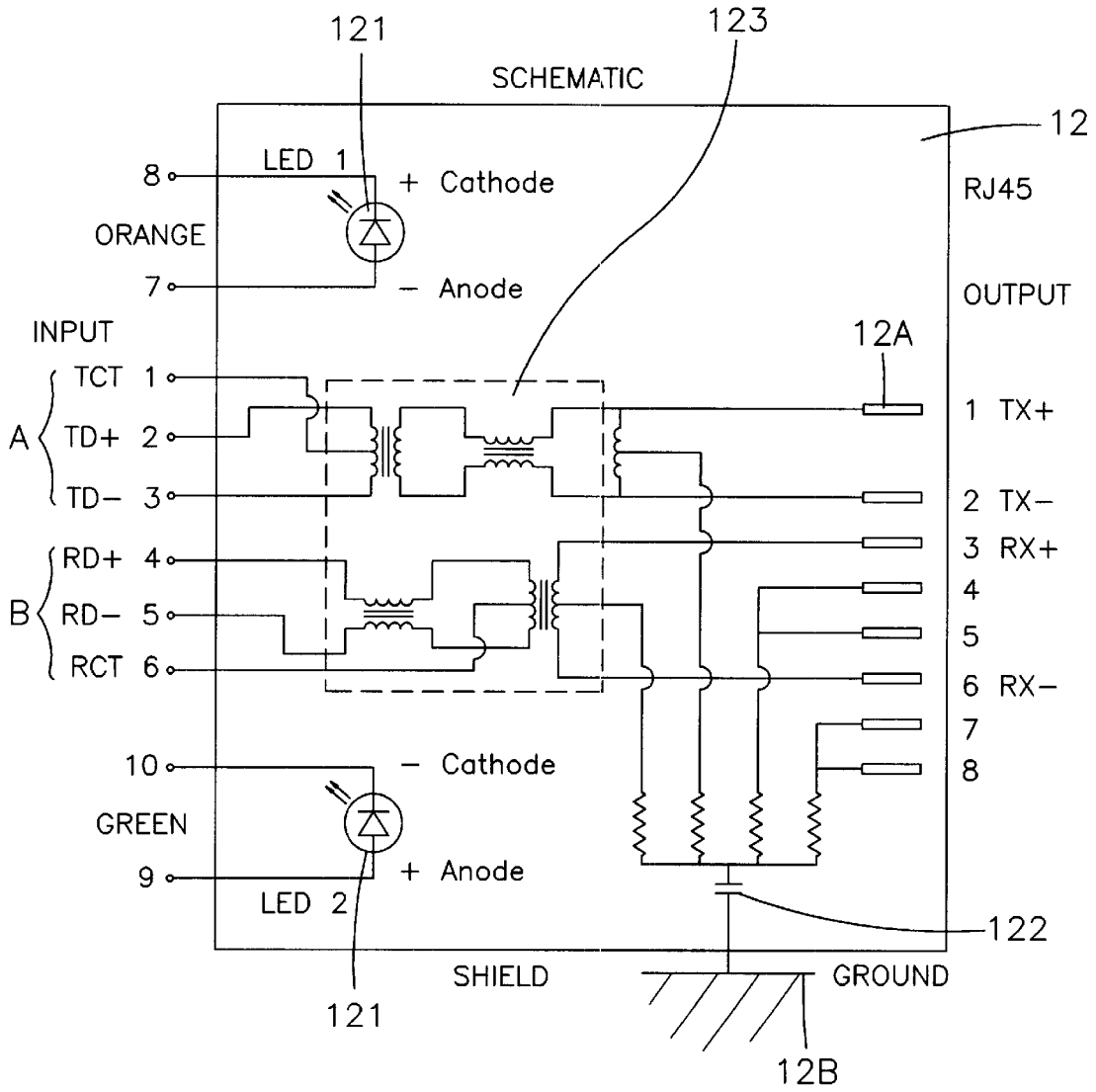
FIG. 5 illustrates the circuit layout of the circuit board for the electric connector according to the present invention.
Figure 6:
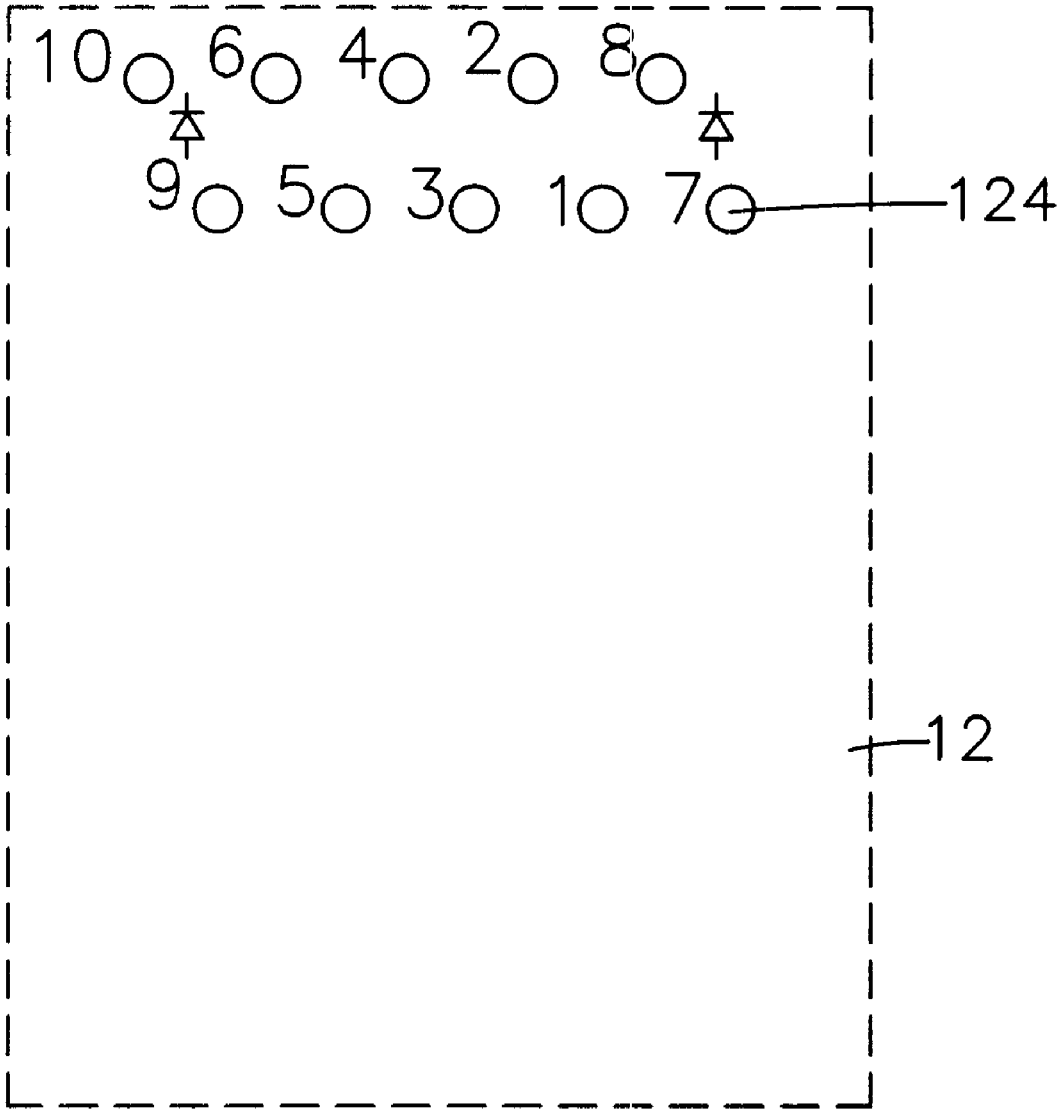
FIG. 6 illustrates the arrangement of the contact holes of the circuit board according to the present invention.
Figure 7:
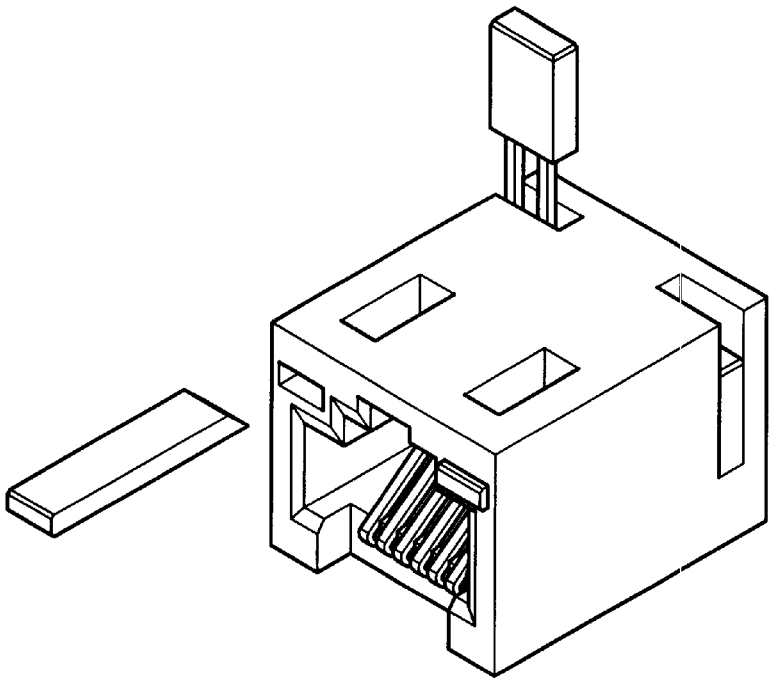
PRIOR ART FIG. 7
FIG. 7 is an exploded view of an electric connector according to the prior art.
Figure 8:
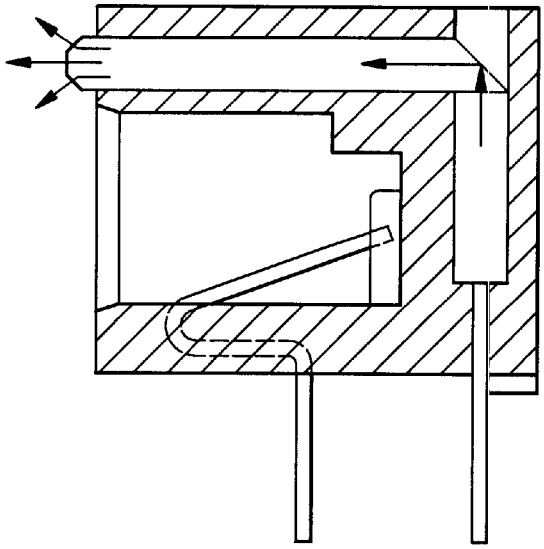
PRIOR ART FIG. 8
FIG. 8 is a sectional assembly view of the prior art electric connector shown in FIG. 7.
Figure 9:
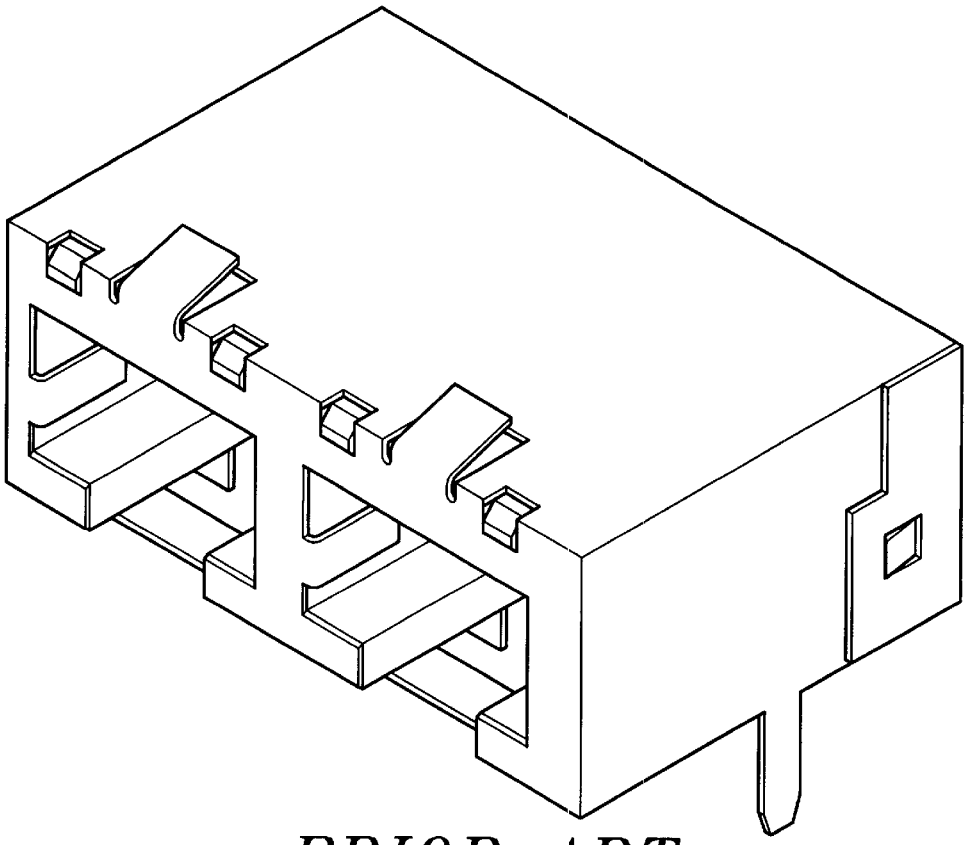
PRIOR ART FIG. 9
FIG. 9 is an elevational view of another structure of electric connector according to the prior art.
Figure 10:
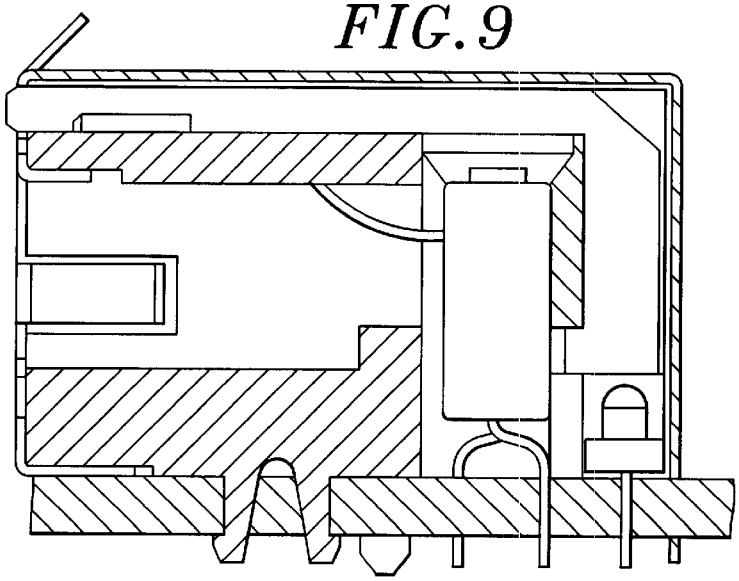
PRIOR ART FIG. 10
FIG. 10 is a sectional side view of the prior art electric connector shown in FIG. 9.
Figure 11:
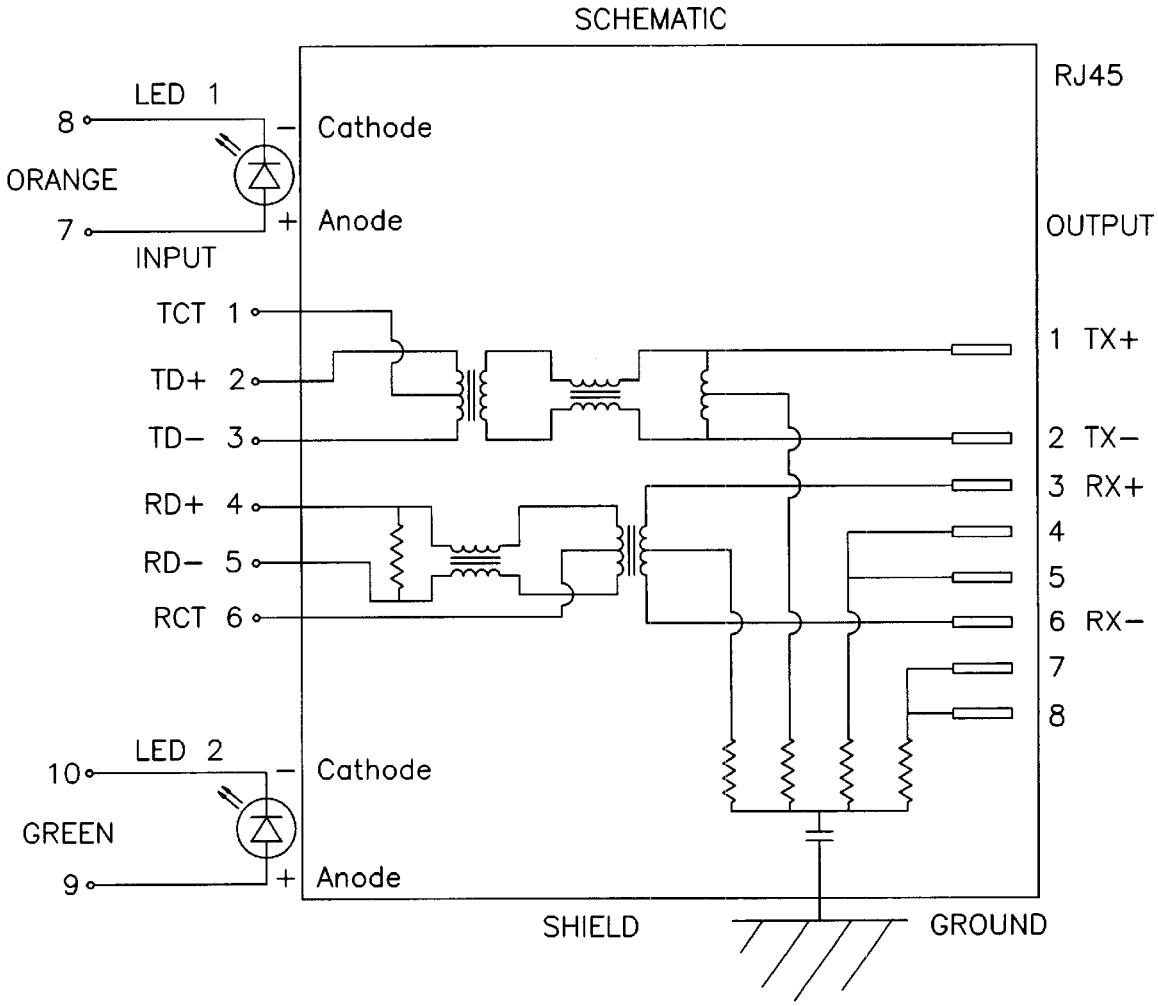
PRIOR ART FIG. 11
FIG. 11 illustrates the circuit layout of the circuit board for the prior art electric connector shown in FIG. 9.
Figure 12:
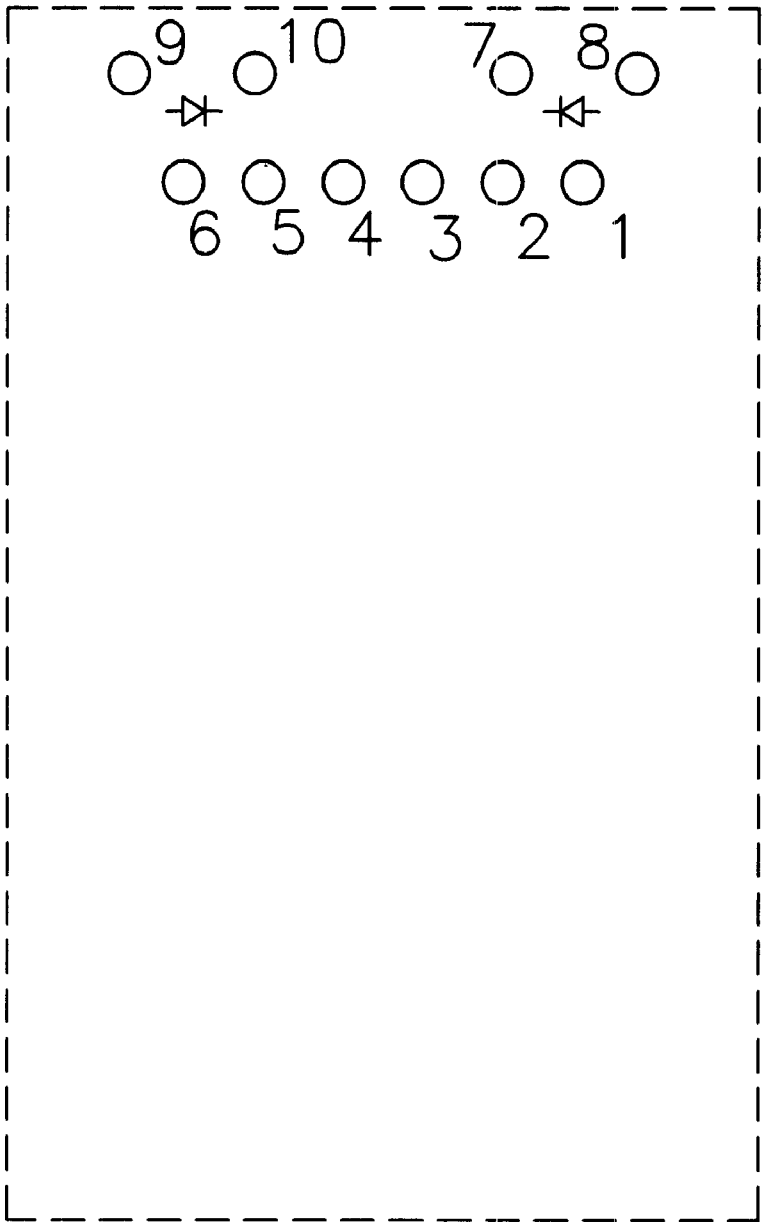
PRIOR ART FIG. 12
FIG. 12 illustrates the arrangement of the contact holes of the circuit board according to the prior art.
Figure 13:
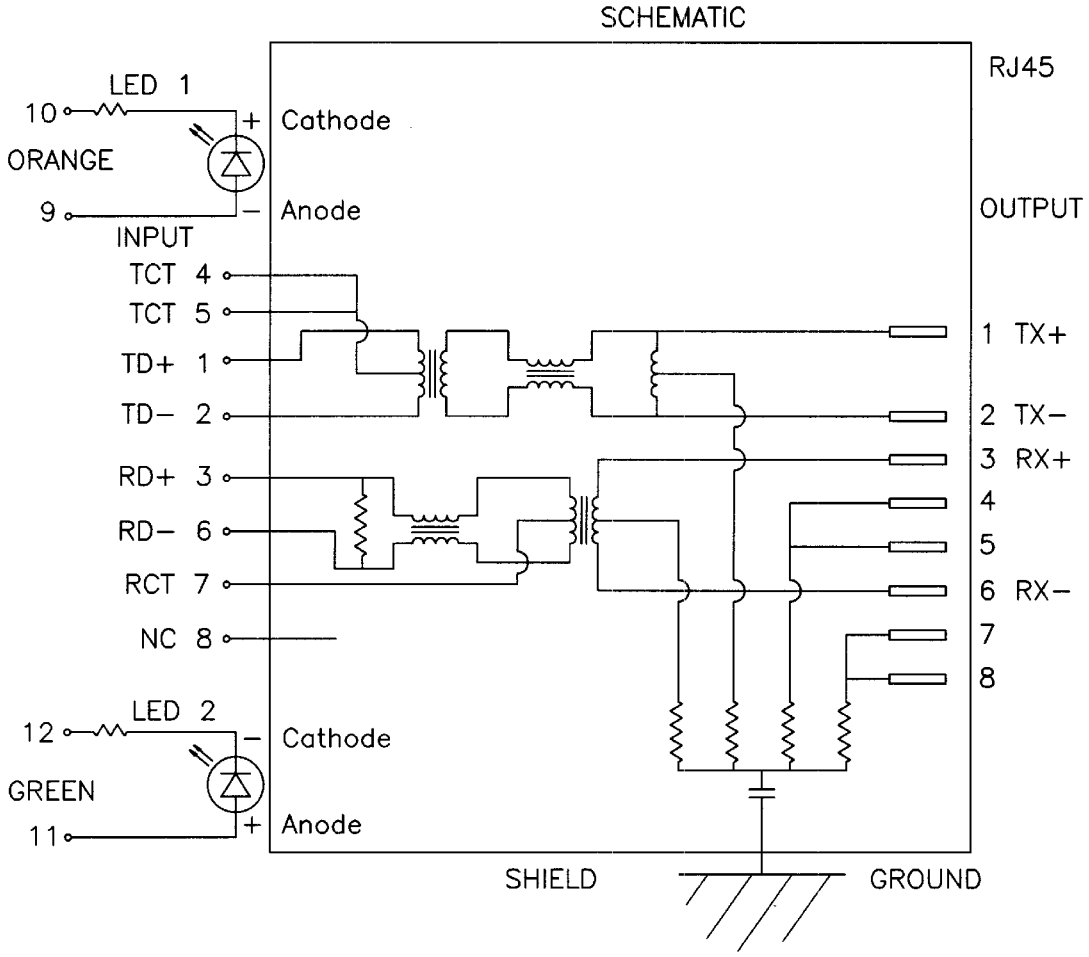
PRIOR ART FIG. 13
FIG. 13 illustrates the circuit layout of another structure of circuit board according to the prior art.
Figure 14:
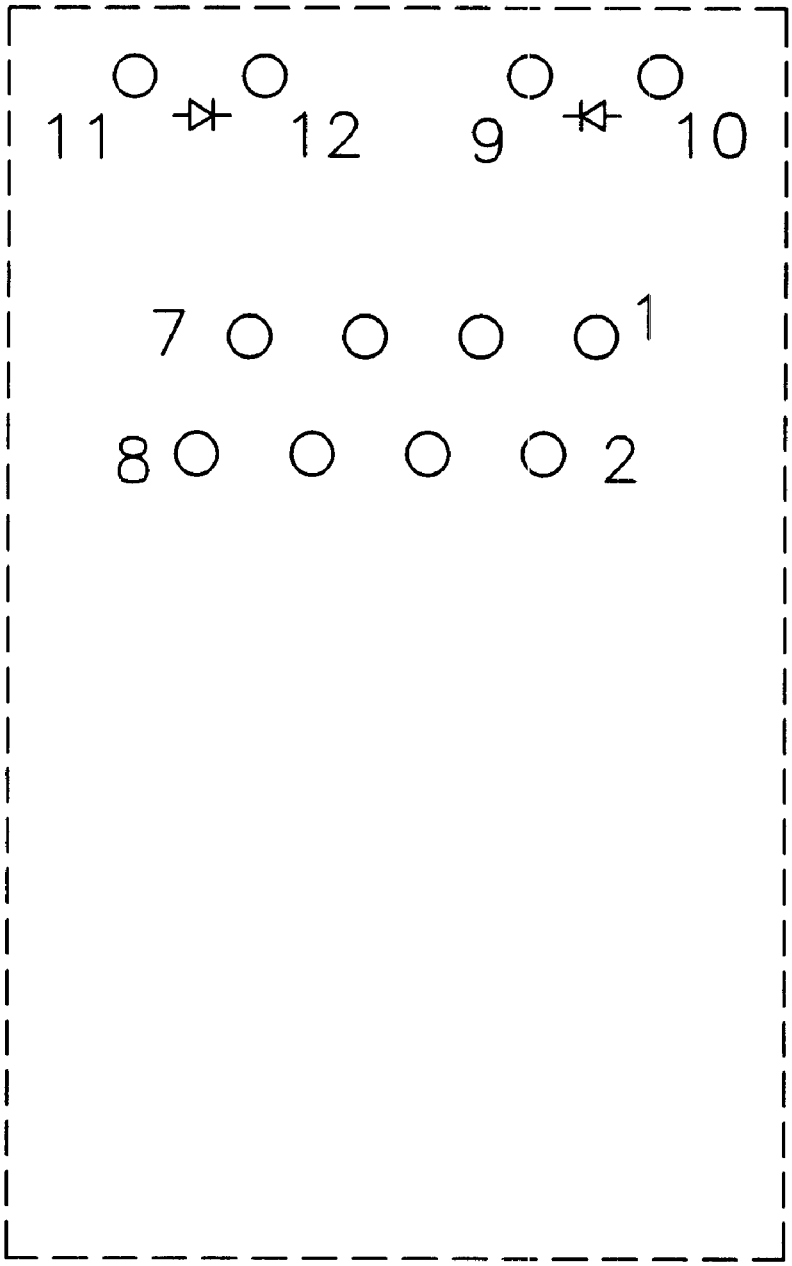
PRIOR ART FIG. 14
FIG. 14 illustrates the arrangement of the contact holes of the circuit board according to the design of FIG. 13.

Referring to FIGS. 5 and 6 and FIG. 2 again, the circuit board has eight output ends 12A respectively connected to the terminals 114 of the terminal holder 11. The capacitor 122 and the filter module 123 are connected in parallel to the output ends 12A. The capacitor 122 is also connected to a grounding terminal 12B. The filter module 123 is directly connected to six input ends 12C of the circuit board 12. The terminals 1122 of the circuit board 12 are respectively connected to the six input ends 12C. The four lead-wires out wires 1211 of the two light emitting diodes 121 and the terminals 1122 are respectively soldered to the circuit board 12. The circuit board 12 has contact holes 124 arranged in two rows (see FIG. 6). The terminal slots 1121 of the rear extension board 112 are arranged in two rows corresponding to the contact holes 124 of the circuit board 12. After connected to the contact holes 124 of the circuit board 12, the terminals 1122 are respectively inserted through the terminal slots 1121 of the rear extension board 112 of the terminal holder 11 for connection to a respective contact of an external circuit board. The arrangement of the contact holes 124 of the circuit board 12 is determined subject to the signal definition of the terminals 114 of the terminal holder 11 and the lead-out wires 1211 of the light emitting diodes 121.

Figure 2:
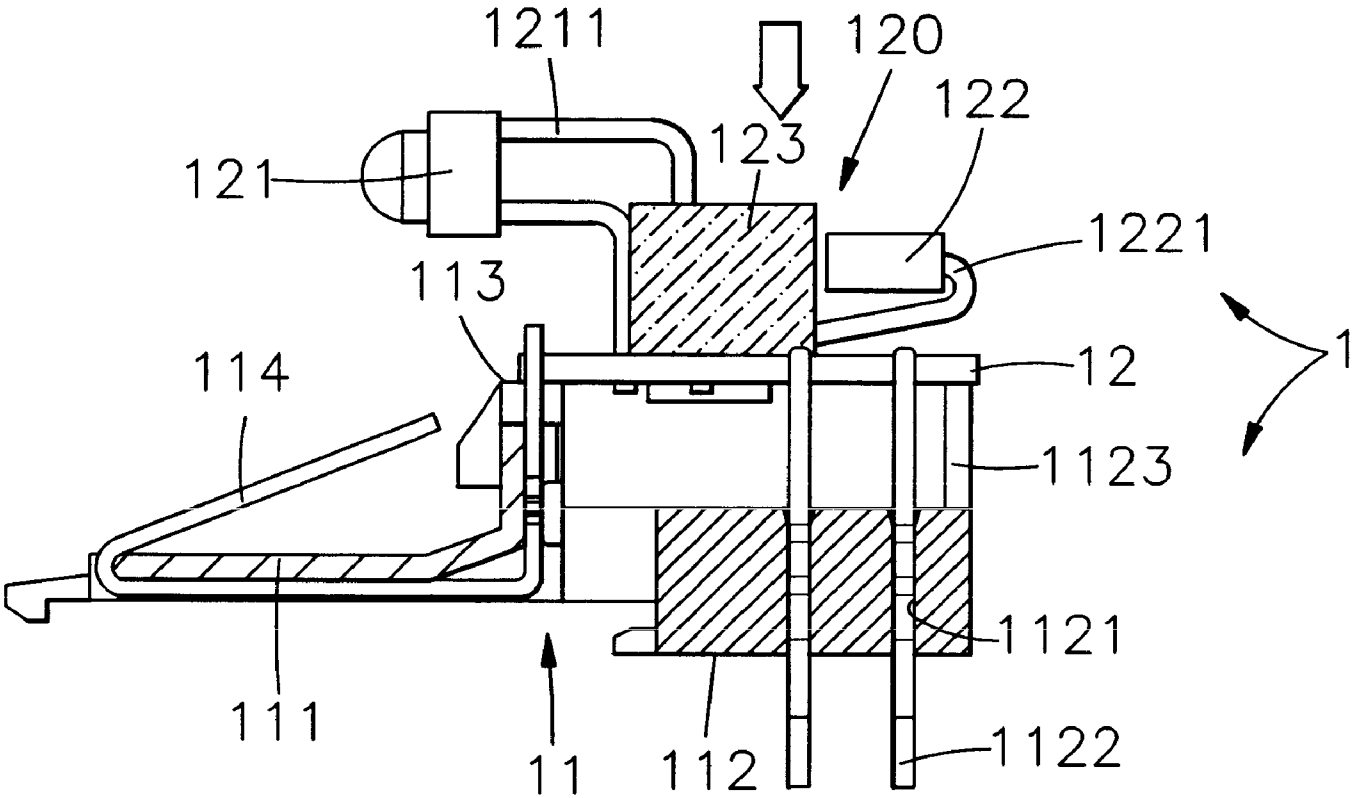
FIG. 2 is a sectional assembly view of the electric circuit assembly unit for the electric connector according to the present invention.
Figure 3:
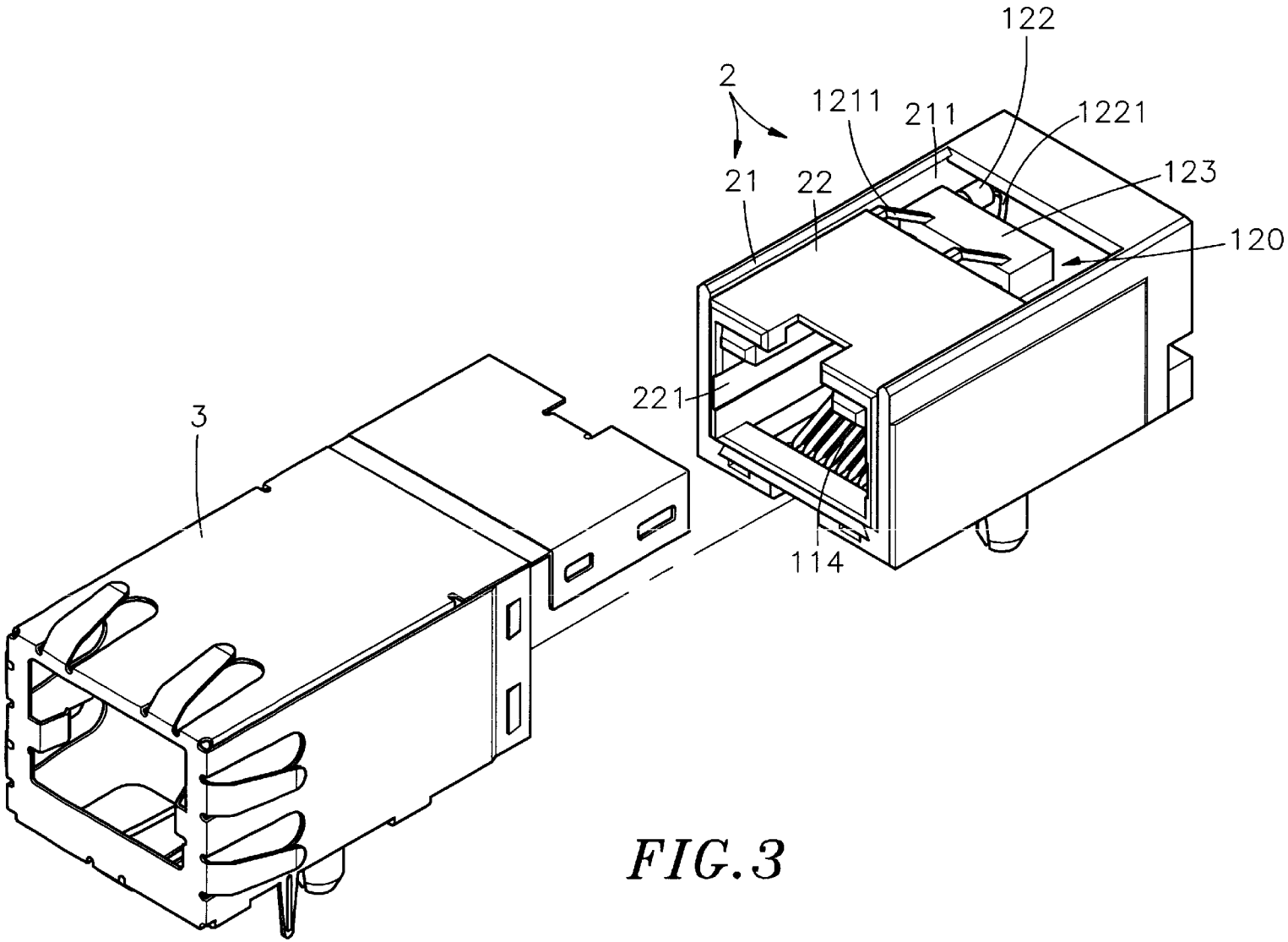
FIG. 3 is an exploded side view of the electric circuit assembly unit showing the electric circuit assembly unit installed in the electrically insulative housing.
Figure 4:
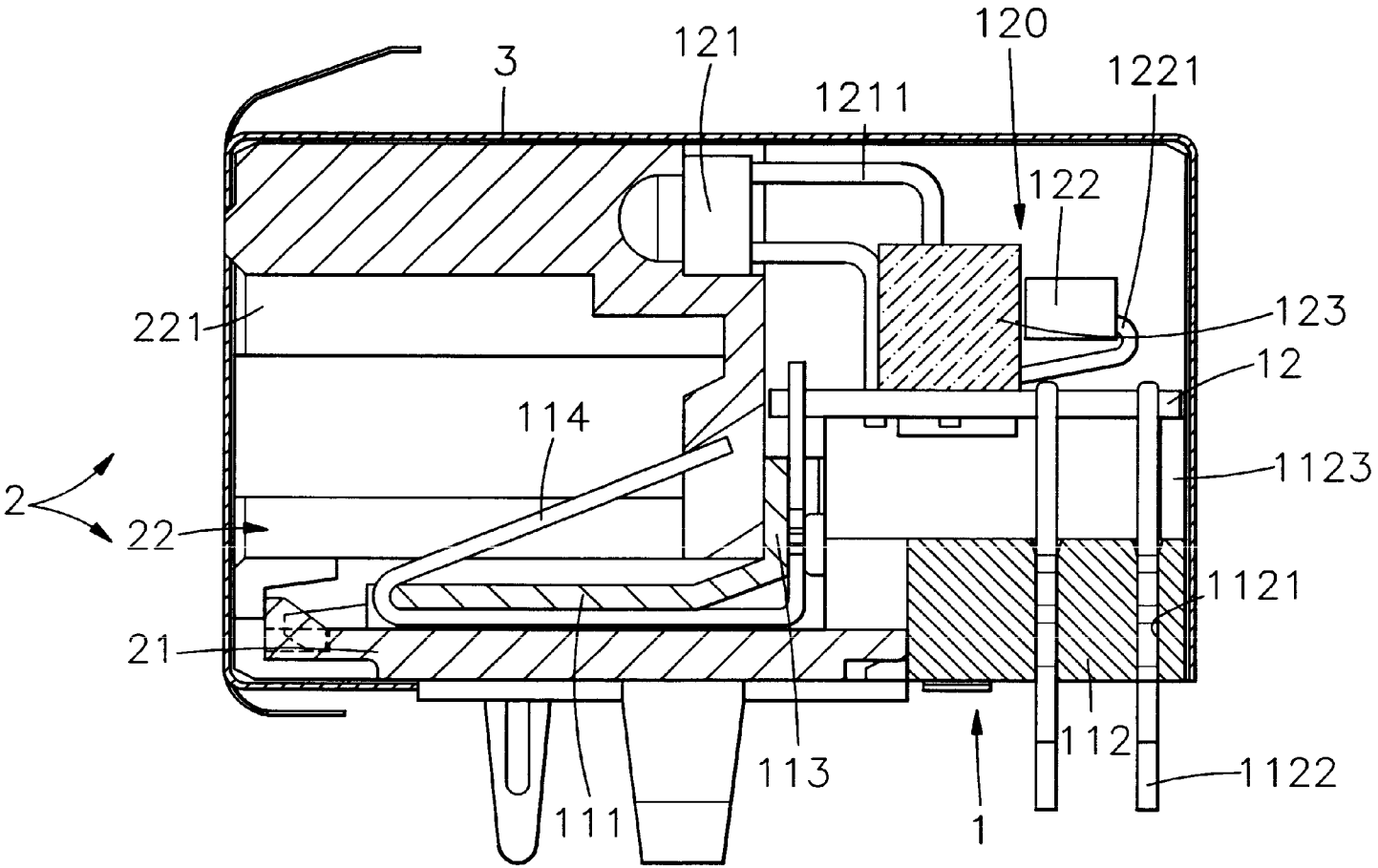
FIG. 4 is a side view in section of the electric connector according to the present invention.

The assembly process of the present invention is outlined hereinafter with reference to FIGS. 1 and 2. The light emitting diodes 121, the capacitor 122, and the filter module 123 are soldered to the circuit board 12 at the top side and the terminals 1122 are respectively soldered to the circuit board 12 at the bottom side, and then the circuit board 12 is supported on the base 113 and upright support 1123 of the terminal holder 11 for enabling the terminals 1122 to be respectively inserted through the terminal slots 1121 of the rear extension board 112 of the terminal holder 11 and soldered to the respective contacts of the external circuit board (not shown), and then the inner casing 22 is inserted into the outer casing 21 from the rear side of the outer casing 21, and then the front extension board 111 of the terminal holder 11 is inserted into the gap between the bottom sidewall of the inner casing 22 and the bottom sidewall of the outer casing 21, and then the metal shield 3 is covered on the electrically insulative housing 2 to finish the assembly procedure. When assembled, the terminals 114 of the terminal holder 11 are suspended in the receiving chamber 221 of the inner casing 22 of the electrically insulative housing 2 for the contact of the respective terminals of the matching electric connector (not shown).

As indicated above, the filter module 123 of the electronic component part unit 120 of the circuit board 12 are respectively connected to six signal terminals of the terminals 114 of the terminal holder 11 through the six input ends 12C of the circuit board 12 to eliminate interference of noises or transient voltage from the circuit.

Further, the lead-out wires 1211 of the light emitting diodes 121 are respectively connected to the circuit board 12. During signal transmission through the electric connector, the light emitting diodes 121 are turned on to emit light toward the front side of the electric connector, indicating the operation status of the electric connector.

A prototype of electric connector has been constructed with the features of FIGS. 1~6. The electric connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric connector comprising an electrically insulative housing, an electric circuit assembly unit installed in said electrically insulative housing, and a metal shield covered on said electrically insulative housing, said electric circuit assembly unit comprising a terminal holder holding a set of terminals and mounted in said electrically insulative housing, and a circuit board supported on said terminal holder, said terminal holder comprising a base, a front extension board forwardly extended from said base, and a rear extension board backwardly extended from said base, said circuit board comprising two light emitting diodes controlled to emit light toward a front receiving side of said electrically insulative housing, wherein said terminal holder comprises ten terminal slots vertically extended through the rear extension board thereof and arranged in two rows; said circuit board comprises ten terminals arranged in two rows and respectively inserted through respective terminal slots of said terminal holder, the terminals of said circuit board including four terminals respectively connected to lead-out wires of said light emitting diodes and six signal receiving and transmitting terminals respectively connected to the terminals of said terminal holder.

2. The electric connector of claim 1 wherein said circuit board is horizontally supported on said terminal holder above said rear extension board.

3. The electric connector of claim 1 wherein said electrically insulative housing is comprised of an outer casing and an inner casing mounted in said outer casing.

4. The electric connector of claim 1 wherein said circuit board comprises a capacitor.

5. The electric connector of claim 1 wherein said circuit board comprises a filter module.

6. The electric connector of claim 1 wherein said rear extension board of said terminal holder comprises an upright support adapted to support said circuit board horizontally on the base of said terminal holder.

* * * * *